US010850937B2

(12) United States Patent
Strain et al.

(10) Patent No.: US 10,850,937 B2
(45) Date of Patent: Dec. 1, 2020

(54) TAIL SEALING APPARATUS

(71) Applicants: Victoria Grace Strain, Symmes Township, OH (US); Gustav Andre Mellin, Amberley Village, OH (US)

(72) Inventors: Victoria Grace Strain, Symmes Township, OH (US); Gustav Andre Mellin, Amberley Village, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 279 days.

(21) Appl. No.: 14/968,938

(22) Filed: Dec. 15, 2015

(65) Prior Publication Data

US 2018/0029817 A1 Feb. 1, 2018

(51) Int. Cl.
*B65H 19/29* (2006.01)

(52) U.S. Cl.
CPC ... *B65H 19/29* (2013.01); *B65H 2301/41484* (2013.01); *B65H 2301/414421* (2013.01); *B65H 2301/414433* (2013.01); *B65H 2301/414436* (2013.01); *B65H 2301/414446* (2013.01); *B65H 2406/20* (2013.01); *B65H 2701/1924* (2013.01)

(58) Field of Classification Search
CPC ..... B65H 19/29; B65H 75/28; B65H 75/285; B65H 2301/414421; B65H 2301/414433
USPC ..... 156/378, 546
See application file for complete search history.

(56) References Cited

U.S. PATENT DOCUMENTS

| | | | | |
|---|---|---|---|---|
| 3,806,388 | A | 4/1974 | Contini | |
| 3,960,272 | A | 6/1976 | Hartbauer et al. | |
| 4,026,752 | A | 5/1977 | Hartbauer | |
| 4,422,588 | A * | 12/1983 | Nowisch | B26D 1/225 156/259 |
| 4,517,787 | A * | 5/1985 | Kreager | B65B 9/207 118/411 |
| 5,681,421 | A * | 10/1997 | Biagiotti | B65H 19/29 156/187 |
| 6,682,623 | B1 * | 1/2004 | Biagiotti | B65H 19/29 156/187 |
| 9,082,321 | B2 | 7/2015 | Nahm | |
| 2004/0096483 | A1 | 5/2004 | Wilks et al. | |
| 2007/0102552 | A1 * | 5/2007 | Gambini | B65H 18/28 242/160.1 |
| 2008/0194454 | A1 | 8/2008 | Morgan et al. | |
| 2010/0087357 | A1 | 4/2010 | Morgan, III et al. | |

(Continued)

FOREIGN PATENT DOCUMENTS

| | | |
|---|---|---|
| GB | 1 167 767 A | 10/1969 |
| JP | 2009 220975 | 10/2009 |
| WO | WO 2014/102685 A1 | 7/2014 |

OTHER PUBLICATIONS

PCT International Search Report dated May 2, 2016—6 pages.

(Continued)

*Primary Examiner* — George R Koch

(74) *Attorney, Agent, or Firm* — Richard L. Alexander; Andrew J. Mueller

(57) ABSTRACT

A nonadhesive phase-change material application apparatus for bonding the tail of a convolutely wound log to the body is provided. The nonadhesive phase-change material application apparatus has at least one nonadhesive phase-change material applicator that defines a cavity conveying a volume of nonadhesive phase-change material from a reservoir to an application site.

20 Claims, 10 Drawing Sheets

(56) References Cited

U.S. PATENT DOCUMENTS

| | | | |
|---|---|---|---|
| 2011/0277938 | A1 | 11/2011 | Gambini |
| 2012/0031564 | A1 | 2/2012 | Gelli |
| 2014/0131498 | A1 | 5/2014 | Brokopp |
| 2014/0364357 | A1 | 12/2014 | Angel et al. |

OTHER PUBLICATIONS

All Office Actions, U.S. Appl. No. 14/968,9368.
International Search Report and Written Opinion, PCT/US2015/064728.
International Search Report and Written Opinion, PCT/US2016/036309.

* cited by examiner

TAIL SEALING APPARATUS

TECHNICAL FIELD

The present disclosure provides for an apparatus for attaching the tail to the body of a convolutely wound log of web material.

BACKGROUND

In the manufacture of rolled web products, such as bath tissue or paper towels, a winder winds a web of material to form a large parent roll. The parent roll is then subsequently unwound, subjected to a variety of conversions, such as embossing, and then rewound by a rewinder into a consumer diameter sized convolutely wound log. The convolutely wound log is eventually cut into consumer width sized rolls, such as bath tissue, paper towels and similar finished products. To efficiently process the convolutely wound log through converting processes, cutting and packaging, the loose end of the log (i.e., the tail) is often secured or sealed to the body (i.e., the non-tail portion) during a tail sealing process.

Common gluing, moistening and other systems known to those in the tail sealing art typically require some manipulation of the tail for correct alignment for adhesive application, proper winding or rewinding and the like. In most commercially available embodiments, the tail is laid flat and unwrinkled against the log with the tail being secured to the log at a position a short distance from the very end of the tail using an adhesive-based material. This tail sealing arrangement leaves a small length of the end of the tail unsecured (the so-called "tab") to enable the end user to grasp, unseal and unwind the convolutely wound product.

The teal sealing process is typically used to aid in the downstream converting processes, such as to keep the roll from undesirably becoming unwound before it has been properly packaged. As a consequence, however, the consumer is tasked with breaking the bond in order to use the rolled web product. Many known systems have been found deficient when attempting to obtain an amount of adhesion or type of adhesive that is sufficient for downstream manufacturing processes, yet not forming a bond that may be considered too strong from a consumer perspective. If the bond strength is too low, the processing difficulty may be experienced yet if the bond strength is too high, a consumer interacting with the wound roll may experience difficulty when attempting to separate the tail from the wound roll from the body. For example, if the strength of the bond is stronger than the web substrate, the web material may undesirably tear when a consumer attempts to separate the tail from the body. In such instances, the torn portions of the roll may be considered unusable and wasted, resulting in consumer dissatisfaction or frustration.

Thus, it would be advantageous to provide for a tail sealing apparatus that addresses one or more of these issues. Indeed, it would be advantageous to provide for a tail sealing apparatus that facilitates sufficient bonding for downstream converting operations while reducing negative end user feedback during interactions with the roll.

SUMMARY

The present disclosure fulfills the needs described above by, in one embodiment, providing a system for adhesively bonding a tail of a convolutely wound log of web material to a body of the convolutely wound log of web material. The system comprises a tail identifying system for identifying the presence and position of a tail and a nonadhesive phase-change material application apparatus positioned downstream from the tail identifying system to receive the log from the tail identifying system. The nonadhesive phase-change material application apparatus comprises at least one nonadhesive phase-change material reservoir for storing nonadhesive phase-change material in an amorphous phase and a plurality of nonadhesive phase-change material applicators that are each translatable between a first position and a second position. Each of the plurality of nonadhesive phase-change material applicators are submergible into the nonadhesive phase-change material in the first position. Each of the plurality of nonadhesive phase-change material applicators are configured to contact a tail in the second position. Each of the plurality of nonadhesive phase-change material applicators defines a cavity for carrying nonadhesive phase-change material during translation from the first position to the second position.

In another embodiment, a nonadhesive phase-change material application apparatus is provided that comprises at least one nonadhesive phase-change material reservoir for storing nonadhesive phase-change material in an amorphous phase. The apparatus also comprises a reciprocating member comprising a plurality of applicators extending therefrom, where the reciprocating member is translatable between a first position and a second position along an axis of translation. Each of the plurality of applicators comprises a first end portion and a second end portion, where the first end portion defines a cavity, where the second end portion is coupled to the reciprocating member, and where the cavity is sized to fill with a volume of nonadhesive phase-change material when the reciprocating member is in the first position.

In yet another embodiment, a nonadhesive phase-change material application apparatus is provided that comprises at least one nonadhesive phase-change material reservoir for storing nonadhesive phase-change material in an amorphous phase, a reciprocating member extending in a cross-direction. The reciprocating member is translatable between a first position and a second position. The apparatus also comprises a plurality of cylindrical applicators disposed along the reciprocating member in the cross-direction. Each of the plurality of cylindrical applicators comprises a first end portion defining a cavity, and where the cavity is sized to fill with a volume of nonadhesive phase-change material when the reciprocating member is in the first position. In yet another embodiment, a system for adhesively bonding a tail of a convolutely wound log of web material to a body of the convolutely wound log of web material is provided that comprises a tail identifying system for identifying the presence and position of a tail and a nonadhesive phase-change material application system positioned downstream from the tail identifying system to receive the log from the tail identifying system. The nonadhesive phase-change material application system comprises a nonadhesive phase-change material reservoir for storing nonadhesive phase-change material in an amorphous phase and a plurality of nonadhesive phase-change material applicators. Each of the plurality of nonadhesive phase-change material applicators defines a cavity in fluid communication with the one nonadhesive phase-change material reservoir. The cavity is selectably fillable with the nonadhesive phase-change material.

DETAILED DESCRIPTION

Figure 1:
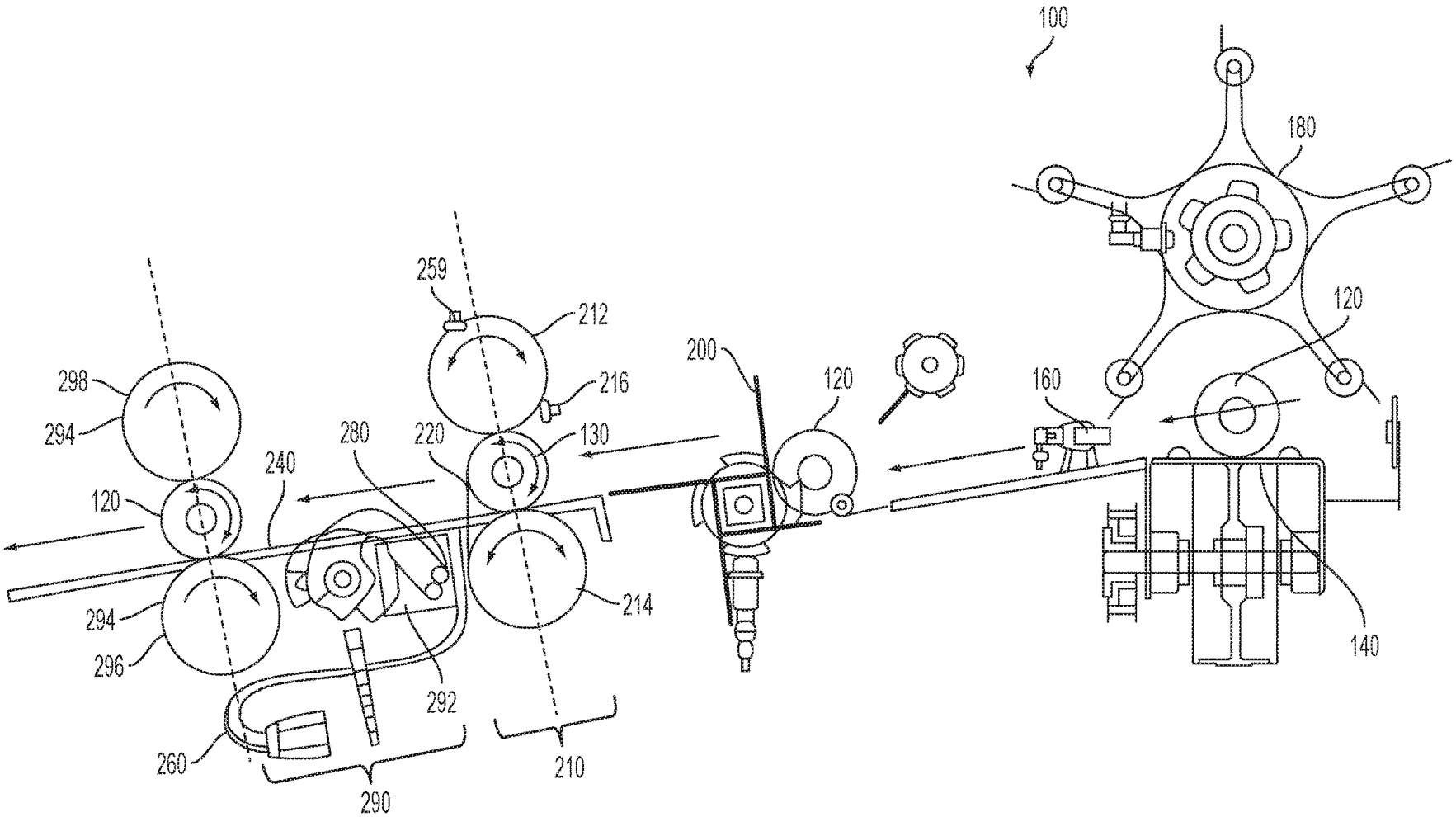
FIG. 1 is an exemplary tail sealing system comprising a nonadhesive phase-change material (PCM) application apparatus.

The present disclosure provides for apparatuses for tail sealing a convolutely wound log of material using a nonadhesive phase-change material. Various nonlimiting embodiments of the present disclosure will now be described to provide an overall understanding of the principles of the function, design and use of the tail sealing apparatuses as well as the tail sealed convolutely wound products disclosed herein. One or more examples of these nonlimiting embodiments are illustrated in the accompanying drawings. Those of ordinary skill in the art will understand that the apparatuses described herein and illustrated in the accompanying drawings are nonlimiting example embodiments and that the scope of the various nonlimiting embodiments of the present disclosure are defined solely by the claims. The features illustrated or described in connection with one nonlimiting embodiment can be combined with the features of other nonlimiting embodiments. Such modifications and variations are intended to be included within the scope of the present disclosure.

Definitions

"Fibrous structure" as used herein means a structure that comprises one or more filaments and/or fibers. Nonlimiting examples of processes for making fibrous structures include known wet-laid papermaking processes and air-laid papermaking processes. Such processes typically include steps of preparing a fiber composition in the form of a suspension in a medium, either wet, more specifically aqueous medium, or dry, more specifically gaseous, i.e. with air as medium. The aqueous medium used for wet-laid processes is oftentimes referred to as a fiber slurry. The fibrous slurry is then used to deposit a plurality of fibers onto a forming wire or belt such that an embryonic fibrous structure is formed, after which drying and/or bonding the fibers together results in a fibrous structure. Further processing the fibrous structure may be carried out such that a finished fibrous structure is formed. For example, in typical papermaking processes, the finished fibrous structure is the fibrous structure that is wound on the reel at the end of papermaking and may subsequently be converted into a finished product (e.g., a sanitary tissue product such as a paper towel product). The fibrous structures of the present disclosure may be homogeneous or may be layered. If layered, the fibrous structures may comprise at least two and/or at least three and/or at least four and/or at least five layers. The fibrous structures of the present disclosure may be co-formed fibrous structures.

"Fiber" and/or "Filament" as used herein means an elongate particulate having an apparent length greatly exceeding its apparent width (i.e., a length to diameter ratio of at least about 10). In one example, a "fiber" is an elongate particulate as described above that exhibits a length of less than 5.08 cm (2 in.) and a "filament" is an elongate particulate as described above that exhibits a length of greater than or equal to 5.08 cm (2 in.).

Fibers are typically considered discontinuous in nature. Nonlimiting examples of fibers include wood pulp fibers and synthetic staple fibers such as polyester fibers.

Filaments are typically considered continuous or substantially continuous in nature. Filaments are relatively longer than fibers. Nonlimiting examples of filaments include meltblown and/or spunbond filaments. Nonlimiting examples of materials that can be spun into filaments include natural polymers, such as starch, starch derivatives, cellulose and cellulose derivatives, hemicellulose, hemicellulose derivatives, and synthetic polymers including, but not limited to polyvinyl alcohol filaments and/or polyvinyl alcohol derivative filaments, and thermoplastic polymer filaments, such as polyesters, nylons, polyolefins such as polypropylene filaments, polyethylene filaments, and biodegradable or compostable thermoplastic fibers such as polylactic acid filaments, polyhydroxyalkanoate filaments and polycaprolactone filaments. The filaments may be monocomponent or multicomponent, such as bicomponent filaments.

In one example of the present disclosure, "fiber" refers to papermaking fibers. Papermaking fibers useful in the present disclosure include cellulosic fibers commonly known as wood pulp fibers. Applicable wood pulps include chemical pulps, such as kraft, sulfite, and sulfate pulps, as well as mechanical pulps including, for example, groundwood, thermomechanical pulp and chemically modified thermomechanical pulp. Chemical pulps, however, may be preferred since they impart a superior tactile sense of softness to tissue sheets made therefrom. Pulps derived from both deciduous trees (hereinafter, also referred to as "hardwood") and coniferous trees (hereinafter, also referred to as "softwood") may be utilized. The hardwood and softwood fibers can be blended, or alternatively, can be deposited in layers to provide a stratified web. Also applicable to the present disclosure are fibers derived from recycled paper, which may contain any or all of the above categories as well as other non-fibrous materials such as fillers and adhesives used to facilitate the original papermaking.

"Sanitary tissue product" as used herein means a soft, low density (i.e., <about 0.15 g/cm$^3$) web useful as a wiping implement for post-urinary and post-bowel movement cleaning (toilet tissue), for otorhinolaryngological discharges (facial tissue) and multi-functional absorbent and cleaning uses (absorbent towels). The sanitary tissue product may be convolutely wound upon itself about a core or without a core to form a sanitary tissue product roll.

The sanitary tissue products and/or fibrous structures of the present disclosure may exhibit a basis weight of greater than 15 g/m$^2$ (9.2 lbs/3000 ft$^2$) to about 120 g/m$^2$ (73.8 lbs/3000 ft$^2$) and/or from about 15 g/m$^2$ (9.2 lbs/3000 ft$^2$) to about 110 g/m$^2$ (67.7 lbs/3000 ft$^2$) and/or from about 20 g/m$^2$ (12.3 lbs/3000 ft$^2$) to about 100 g/m$^2$ (61.5 lbs/3000 ft$^2$) and/or from about 30 (18.5 lbs/3000 ft$^2$) to 90 g/m$^2$ (55.4 lbs/3000 ft$^2$). In addition, the sanitary tissue products and/or fibrous structures of the present disclosure may exhibit a basis weight between about 40 g/m$^2$ (24.6 lbs/3000 ft$^2$) to about 120 g/m$^2$ (73.8 lbs/3000 ft$^2$) and/or from about 50 g/m$^2$ (30.8 lbs/3000 ft$^2$) to about 110 g/m$^2$ (67.7 lbs/3000 ft$^2$) and/or from about 55 g/m$^2$ (33.8 lbs/3000 ft$^2$) to about 105 g/m$^2$ (64.6 lbs/3000 ft$^2$) and/or from about 60 (36.9 lbs/3000 ft$^2$) to 100 g/m$^2$ (61.5 lbs/3000 ft$^2$).

The sanitary tissue products of the present disclosure may exhibit a total dry tensile strength of greater than about 59 g/cm (150 g/in) and/or from about 78 g/cm (200 g/in) to about 394 g/cm (1000 g/in) and/or from about 98 g/cm (250 g/in) to about 335 g/cm (850 g/in). In addition, the sanitary tissue product of the present disclosure may exhibit a total dry tensile strength of greater than about 196 g/cm (500 g/in) and/or from about 196 g/cm (500 g/in) to about 394 g/cm (1000 g/in) and/or from about 216 g/cm (550 g/in) to about 335 g/cm (850 g/in) and/or from about 236 g/cm (600 g/in) to about 315 g/cm (800 g/in). In one example, the sanitary tissue product exhibits a total dry tensile strength of less than about 394 g/cm (1000 g/in) and/or less than about 335 g/cm (850 g/in).

In another example, the sanitary tissue products of the present disclosure may exhibit a total dry tensile strength of greater than about 196 g/cm (500 g/in) and/or greater than about 236 g/cm (600 g/in) and/or greater than about 276 g/cm (700 g/in) and/or greater than about 315 g/cm (800 g/in) and/or greater than about 354 g/cm (900 g/in) and/or greater than about 394 g/cm (1000 g/in) and/or from about 315 g/cm (800 g/in) to about 1968 g/cm (5000 g/in) and/or from about 354 g/cm (900 g/in) to about 1181 g/cm (3000 g/in) and/or from about 354 g/cm (900 g/in) to about 984 g/cm (2500 g/in) and/or from about 394 g/cm (1000 g/in) to about 787 g/cm (2000 g/in).

The sanitary tissue products of the present disclosure may exhibit an initial total wet tensile strength of less than about 78 g/cm (200 g/in) and/or less than about 59 g/cm (150 g/in) and/or less than about 39 g/cm (100 g/in) and/or less than about 29 g/cm (75 g/in).

The sanitary tissue products of the present disclosure may exhibit an initial total wet tensile strength of greater than about 118 g/cm (300 g/in) and/or greater than about 157 g/cm (400 g/in) and/or greater than about 196 g/cm (500 g/in) and/or greater than about 236 g/cm (600 g/in) and/or greater than about 276 g/cm (700 g/in) and/or greater than about 315 g/cm (800 g/in) and/or greater than about 354 g/cm (900 g/in) and/or greater than about 394 g/cm (1000 g/in) and/or from about 118 g/cm (300 g/in) to about 1968 g/cm (5000 g/in) and/or from about 157 g/cm (400 g/in) to about 1181 g/cm (3000 g/in) and/or from about 196 g/cm (500 g/in) to about 984 g/cm (2500 g/in) and/or from about 196 g/cm (500 g/in) to about 787 g/cm (2000 g/in) and/or from about 196 g/cm (500 g/in) to about 591 g/cm (1500 g/in).

The sanitary tissue products of the present disclosure may exhibit a density (measured at 95 g/in$^2$) of less than about 0.60 g/cm$^3$ and/or less than about 0.30 g/cm$^3$ and/or less than about 0.20 g/cm$^3$ and/or less than about 0.10 g/cm$^3$ and/or less than about 0.07 g/cm$^3$ and/or less than about 0.05 g/cm$^3$ and/or from about 0.01 g/cm$^3$ to about 0.20 g/cm$^3$ and/or from about 0.02 g/cm$^3$ to about 0.10 g/cm$^3$.

The sanitary tissue products of the present disclosure may comprise additives such as softening agents, such as quaternary ammonium softening agents, temporary wet strength agents, permanent wet strength agents, bulk softening agents, lotions, silicones, wetting agents, latexes, dry strength agents, and other types of additives suitable for inclusion in and/or on sanitary tissue products.

The embodiments discussed herein may be utilized with a convolutely wound log of web material, such as a convolutely wound log of a fibrous structure. The fibrous structure may comprise a sanitary tissue product.

"Consumer-sized product unit" as used in herein means the width of a finished product of convolutely wound web material, as measured in the cross machine direction, as such product will be packaged, sold, distributed or otherwise provided to end users.

"Phase-change material" (PCM) as used herein means a substance that changes from a solid phase to an amorphous phase, and vice versa, as heat is absorbed or released. When the PCM is heated to above its transition temperature, the PCM generally behaves as a low viscosity Newtonian fluid. The transition temperature is the temperature at which a phase change from amorphous to non-amorphous occurs or where a remarkable change in viscosity from high viscosity to low viscosity occurs.

"Nonadhesive PCM" as used herein means a PCM is void or substantially void of glue or other types of adhesives. When used to bond web substrates, the nonadhesive PCM utilizes mechanical entanglement of fibers of each of the web substrates to form the bond. Further, unlike adhesive materials, a nonadhesive PCM does not rely on evaporation to transition from an amorphous phase to a non-amorphous phase.

"Application site" as used herein means the desired location at which a nonadhesive PCM is to be deposited on a web material. The application site may be located, for example, on the tail, the body (i.e., the non-tail portion of the log) or, the crevice where the tail and the body meet.

"Machine direction" or "MD" as used herein means the direction parallel to the flow of the web material through the manufacturing equipment.

"Cross machine direction" or "CD" as used herein means the direction parallel to the width of the manufacturing equipment and perpendicular to the machine direction.

The Z-direction is orthogonal both the machine direction and cross machine direction, such that the machine direction, cross machine direction and Z-direction form a Cartesian coordinate system.

"Above", "over", "top", "up", "below", "beneath", "bottom" and "under" and similar orientational words and phrases, except upstream and downstream, as used herein to describe embodiments are to be construed relative to the normal orientation, where the floor is located in the Z-direction below, beneath or under a tail sealing apparatus and the ceiling is located in the Z-direction above or over a tail sealing apparatus. Articles expressed as being above, over, on top and the like are located (or moving) in the Z-direction closer to the ceiling than the items to which they are being compared. Similarly, articles expressed as being below, beneath or under and the like are located (or moving) in the Z-direction closer to the floor than their respective comparators. One of skill in the art will recognize that the relationship between the article and its respective comparator is more significant than the relationship between the article and the floor or the ceiling. As such, inverted arrangements of articles as disclosed herein are included within the scope of this disclosure. Said differently, to the extent such configurations are workable, this disclosure is intended to include an apparatus and/or method where everything expressed as "below" is inverted to be "above" and everything expressed as "above" is inverted to be "below" and similar reversals or inversions.

"Downstream" as used herein means a step or system occurring or present later in a processing continuum. "Upstream" as used herein means a step or system occurring or present earlier in a processing continuum.

Referring now to FIG. 1, an exemplary tail sealer system 100 is depicted in accordance with one nonlimiting embodiment of the present disclosure. The tail sealer system 100 may be positioned directly downstream of a rewinder (not shown) and may be an integral part of a converting operation. Generally, the tail sealer system 100 may be provided with a: 1. Log in-feed; 2. Log index to sealing station; 3. Tail detection and positioning; 4. Nonadhesive PCM application; 5. Tail rewinding; and 6. Log discharge.

As shown in FIG. 1, the wound log 120 enters at the in-feed conveyor 140. An incoming log detector 160 (e.g., a photo eye sensor) detects when the wound log 120 is in position on the in-feed conveyor 140 and activates a rotary kicker 180 that pushes the wound log 120 off the conveyor 140 toward the index paddle 200. The index paddle 200 receives the wound log 120 and holds it until the in-feed rolls 210 are clear. The index paddle 200 then indexes about 90 degrees, moving the wound log 120 into the in-feed rolls 210. In-feed rolls 210 will typically include an upper in-feed roll 212 and a lower in-feed roll 214 (typically a vacuum roll).

The in-feed rolls 210 initially rotate in the same direction but at mismatched speeds, with the upper in-feed roll 212 rotating faster than the lower in-feed (or vacuum) roll 214. The distance of upper in-feed roll 212 relative to lower in-feed roll 214 can be adjusted to accommodate the wound log 120 diameter. However, the upper in-feed roll 212 is typically positioned to create some interference with the wound log 120. When the wound log 120 is fed into the in-feed rolls 210, the wound log 120 may be controlled at the top and bottom log 120 positions because of the interference and rate of log 120 travel is controlled by the speed difference between the in-feed rolls 210. If there is too little or no interference, the wound log 120 could slide through the in-feed rolls 210. Conversely, if there is too much interference, the logs 120 may not feed into the in-feed rolls 210 correctly and could cause a jam up at the index paddle 200.

As the wound log 120 contacts the in-feed rolls 210, it is pulled into the nip between the in-feed rolls 210 by the differential speed. As the wound log 120 reaches the diagonal center of the in-feed rolls 210, it blocks the log in-feed rollers detector 216 (e.g., photo eye sensor) at which time the in-feed rolls 210 rotate at a matched speed. This holds the wound log 120 in position while an airblast nozzle 259 emits a stream of air to separate the tail 220 from the wound log 120 and positions the tail 220 flat onto the table 240 where a tail detector 260 (e.g., a photoelectric cell) becomes blocked by the tail 220. As the wound log 120 rotates and rewinds the separated tail 220, the tail detector 260 becomes unblocked when the edge of the tail 220 has been located.

After the edge of the tail 220 is detected, the tail 220 is rewound onto the wound log 120 until the edge of the tail 220 is directly underneath the body 130 of the wound log 120. The in-feed rolls 210 stop and reverse direction, which unrolls the tail 220 from the body 130. The tail 220 is held by vacuum to the lower in-feed roll 214 and follows the lower in-feed roll 214 as it is unwound until a calculated length of tail 220 has been separated from the body 130. The in-feed rolls 210 then stop and the upper in-feed roll 212 starts rotating back in the forward direction to eject the body 120 from the in-feed rolls 210. The tail length centerline controls the amount of tail 220 that is unwound from the wound log 120 and is typically adjusted to get the target tab length. The speed of in-feed rolls 210 can impact consistent tail detection. Higher speeds can reduce the time to rotate the wound log 120 but may not increase rate capability. The speed of in-feed rolls 210 can be adjusted to consistently detect the tail 220 on the first revolution.

A nonadhesive PCM application system 290 may include a reservoir 292 that can contain a nonadhesive PCM in an amorphous state. In order to maintain a desired viscosity of the nonadhesive PCM the reservoir 292 can be heated. While the tail 220 is being detected, nonadhesive PCM applicators (not shown) coupled to a reciprocating member 284 of the nonadhesive PCM application system 290 are submerged in the reservoir 292. As described in more detail below, each nonadhesive PCM applicator can define a cavity that fills with nonadhesive PCM when the nonadhesive PCM applicator is submerged in the reservoir 292. After the tail of log 220 is detected, the nonadhesive PCM applicators are raised out of the reservoir 292 by the reciprocating member 284 while the nonadhesive PCM applicators carry an amount of the nonadhesive PCM in an amorphous state in their respective cavities. The raising of the nonadhesive PCM applicators can be timed so that the body 130 rolls over the nonadhesive PCM applicators after being ejected from the in-feed rolls 210. After the wound log 120 passes, the nonadhesive PCM applicator are lowered back into the reservoir 292 by the reciprocating member 284. The nonadhesive PCM applicators can be adjusted so that the top of the nonadhesive PCM applicators is slightly higher than the adjacent table 240.

After application of the nonadhesive PCM, the wound log 120 rolls down the table 240 to the out-feed rolls 294 which compress the tail 220 to the body 130. The nonadhesive PCM, while in its amorphous state, wicks through the fibers of each of the tail 220 and the body 130 to form mechanical bonds. In some embodiments, subsequent to applying the heated nonadhesive PCM material to the application site, heat can be removed from the applied nonadhesive PCM to accelerate the phase change from an amorphous state to a non-amorphous (e.g., a solid state) to expedite the bonding process. In other embodiments, ambient temperature is sufficient to change the phase of the nonadhesive PCM at a suitable rate.

The lower out-feed roll 296 runs slower than the upper out-feed roll 298, which moves the wound log 120 through the out-feed rolls 294 for a controlled duration, similar to the in-feed rolls 210. The lower out-feed roll 296 speed is controlled as a percentage of the upper out-feed roll 298 speed. More closely matching the upper out-feed roll 298 and lower out-feed roll 296 speeds will allow the out-feed rolls 294 to hold the wound log 120 longer.

When the wound log 120 is released from the out-feed rolls 294, it rolls down the table 240 to the next converting operation—typically an accumulator in-feed. A typical tail sealer system 100 having a nonadhesive PCM applicator system 290 may operate at a rate of not less than about 20 logs processed/minute, or at rate of about 30 to about 60 logs processed/minute, or a rate of about 50 to about 60 logs processed/minute.

As one of skill in the art will recognize, other arrangements of portions of the exemplary tail sealer system 100 can be used. For instance, the relative speeds of the upper in-feed rolls 212 and lower in-feed rolls 214 may be changed, the table 240 placement as well as the presence of a log in-feed section, log index to sealing station, tail identifying, tail winding and log discharge portions may be modified. As a nonlimiting example, belts may be used in lieu of rolls. Likewise, the angles and distances of the nonadhesive PCM applicator and/or the reservoir 292 relative to the application site and/or table 240 may be altered as may the application pressure or velocity. Additionally, timers and/or other control features may be used to manage the rate of operation and/or prevent backlog or overfeeding of the logs 120 into the tail sealer system 100. Furthermore, while FIG. 1 generally depicts the use of nonadhesive PCM applicators coupled to a reciprocating member 284 for applying the nonadhesive PCM to the wound log 120 subsequent to the tail being unwound from the log, this disclosure is not so limited. For example, in other configurations, nonadhesive PCM applicators can be configured to contact an outer surface of the tail when the tail is in a wound position, as shown in FIGS. 2A-2D. In such embodiments, the nonadhesive PCM is delivered to the outer surface of the wound log 120 and inwardly wicks to form the desired mechanical bonding. Additionally, in some embodiments, the nonadhesive PCM applicator system 290 can include a single reciprocating member 284 to which a plurality of nonadhesive PCM applicators are coupled. In other embodiments, multiple reciprocating members 284 can be used, that each have at least one nonadhesive PCM applicator are coupled thereto. The multiple reciprocating members can reciprocate relative to a common reservoir, or a multiple reservoirs can be used.

Figure 2A:
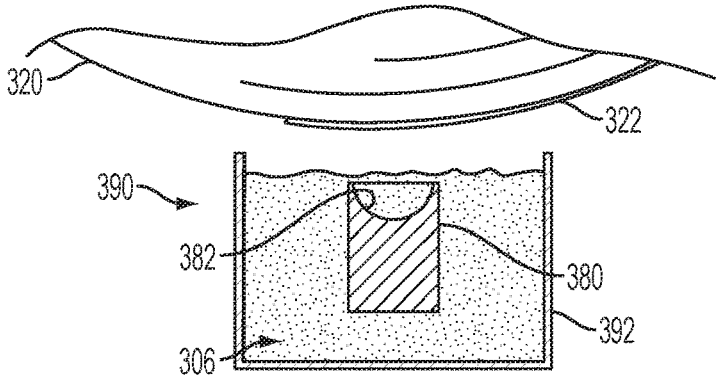
FIGS. 2A-2D schematically depict the progression of an example PCM application apparatus having a nonadhesive PCM applicator and a reservoir, with the nonadhesive PCM applicator and the reservoir shown in cross-section.
Figure 2B:
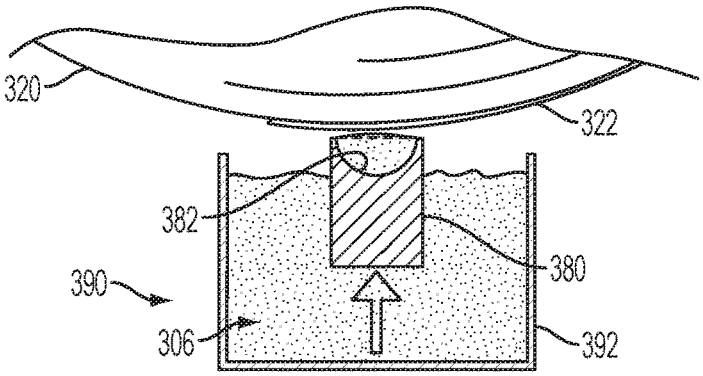
Figure 2C:
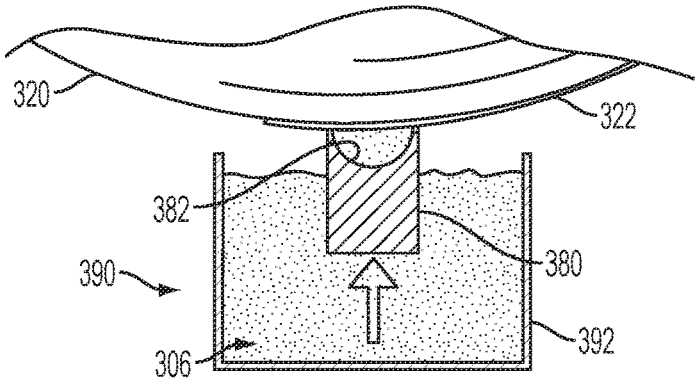
Figure 2D:
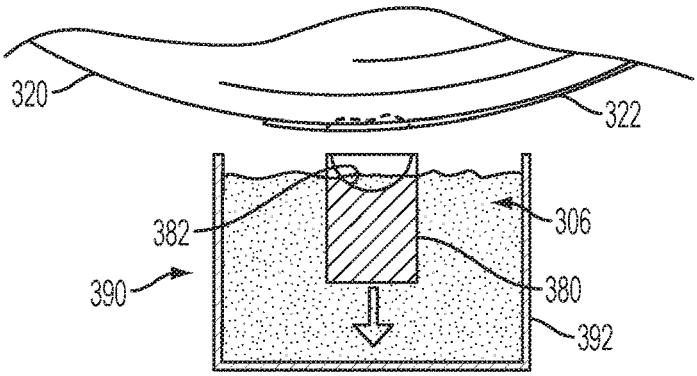

FIGS. 2A-2D schematically depict a progression of an example nonadhesive PCM application system 390. The nonadhesive PCM application system 390 comprises a nonadhesive PCM applicator 380 and a reservoir 392, with the PCM applicator 380 and the reservoir 392 shown in cross-section. A wound log 320 is shown positioned above the nonadhesive PCM application system 390, as may occur during a tail sealing process. While a single nonadhesive PCM applicator 380 is depicted in FIGS. 2A-2D, it is to be appreciated that the nonadhesive PCM application system 390 can include a plurality of nonadhesive PCM applicators that can be configured similarly to the illustrated nonadhesive PCM applicator 380. The reservoir 392 can be heated through any suitable technique to maintain nonadhesive PCM 306 in an amorphous state. In one example embodiment, a heating element (not shown) is utilized to apply heat to the nonadhesive PCM 306. In other embodiments, heated nonadhesive PCM 306 is circulated through the reservoir 392 using a circulation pump (not shown). The nonadhesive PCM applicator 380 can define a cavity 382 that can be filled with a volume of nonadhesive PCM 306. While the cavity 382 is shown being hemispherical, a variety of shapes can be used. Additional details regarding example configurations of the cavity 382 are provided below. The nonadhesive PCM applicator 380 can be translatable between a submerged position (FIG. 2A) and an extended position (FIG. 2C). In the submerged position, the cavity 382 is below the surface of the nonadhesive PCM 306 in the amorphous state such that the cavity 382 fills with the nonadhesive PCM 306. When the wound log 320 is in the desired position (i.e., the tail 322 is positioned above the nonadhesive PCM applicator 380), the nonadhesive PCM applicator 380 can be mechanically raised out of the nonadhesive PCM 306, as shown in FIG. 2B. A volume of nonadhesive PCM 306 is carried out of the reservoir 392 in the cavity 382. In some configurations, due in part to the surface tension of the nonadhesive PCM 306, the nonadhesive PCM 306 that is contained within the cavity 382 can have a convex meniscus that extends above the top of the nonadhesive PCM applicator 380, as shown in FIG. 2B. At the top of its stroke, the nonadhesive PCM applicator 380 can be in contact with an application site of the wound roll 320. In the illustrated embodiment, the application site is located on the outer surface of the tail 322. The nonadhesive PCM applicator 380 can exert an amount of force onto the wound log 320 such that a portion of wound log 320 (i.e., fibers of the tail 322) is driven into the cavity 382 to assist with the transfer of the nonadhesive PCM 306 into the fibers of the wound log 320. In this regard, substantially the entire volume of nonadhesive PCM 306 carried by the cavity 382 can be transferred to the wound roll 320. Subsequent to the transfer, the nonadhesive PCM applicator 380 can be lowered away from the wound roll 320 and re-submerged into the nonadhesive PCM 306 within the reservoir 392, as shown in FIG. 2D.

While FIGS. 2A-2D schematically illustrate the nonadhesive PCM applicator 380 translating along a generally vertical path, the nonadhesive PCM applicator 380 can translate along other suitable paths, such as a generally circular, angled, curved, or oblong path, for example. Furthermore, the nonadhesive PCM applicator 380 can be configured to assist with maintaining the nonadhesive PCM 306 in an amorphous state as it is being transferred from the reservoir 392 to the wound log 320. For example, the cavity 382 of the nonadhesive PCM applicator 380 can be heated. Additionally or alternatively, the nonadhesive PCM applicator 380 can be at least partially formed from conductive material, such as stainless steel to assist with heat management.

Figure 3A:
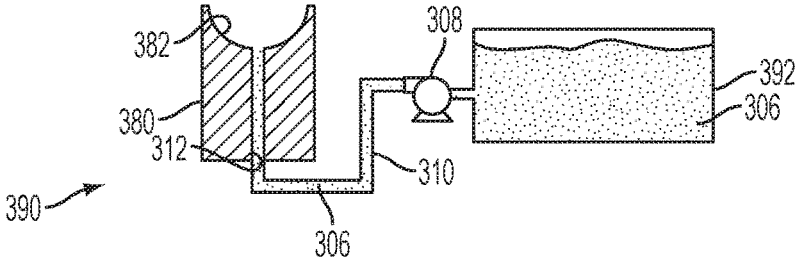
FIGS. 3A-3D schematically depict a progression of an example nonadhesive PCM application system that includes a stationary nonadhesive applicator.
Figure 3B:
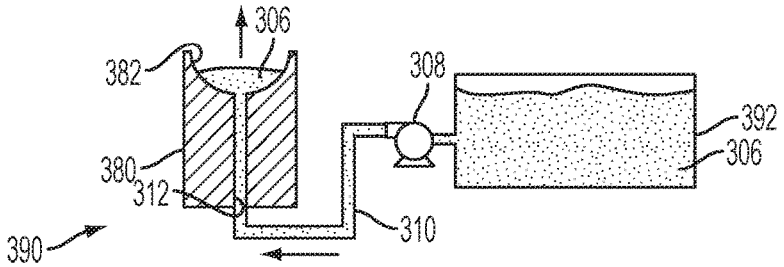
Figure 3C:
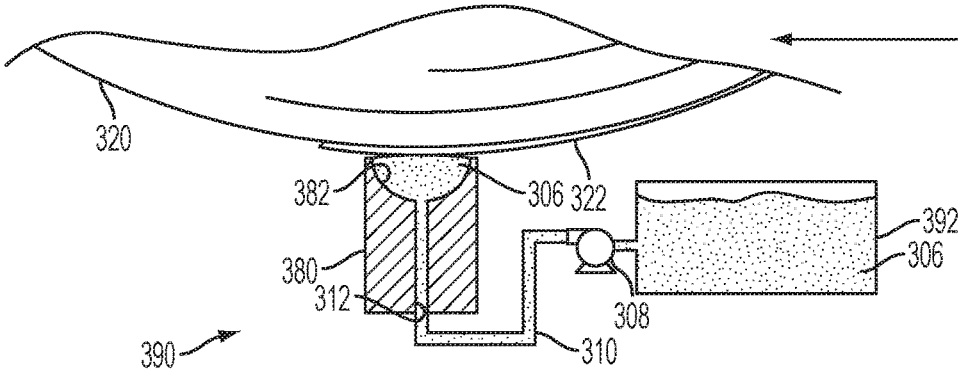

FIGS. 3A-3D schematically depict a progression of an example nonadhesive PCM application system 390 that includes a stationary nonadhesive PCM applicator 380. The cavity 382 of the nonadhesive PCM applicator 380 is in fluid communication with the reservoir 392 such that the cavity 382 can be selectively filled with the nonadhesive PCM 306. In the illustrated embodiment, a pump 308 is schematically shown that is fluidly coupled to the reservoir 392 and a supply line 310. The supply line 310 is in fluid communication with a filling port 312 of the nonadhesive PCM applicator 380. While the filling port 312 is depicted as extending from the bottom of the nonadhesive PCM applicator 380 to the bottom of the cavity 382, this disclosure is not so limited, as any suitable configuration for the filling port 312 and supply line 310 may be utilized. Referring now to FIG. 3A, the cavity 382 is shown in an empty state. As shown in FIG. 3B, when the pump 308 is activated, nonadhesive PCM 306 can be pumped from the reservoir 392, through the supply line 310, into the filling port 312, and into the cavity 382, such that the cavity 382 is filled with the nonadhesive PCM 306. Once the cavity 382 is filled, a wound roll 320 can be rolled across the nonadhesive PCM applicator 380, as shown in FIG. 3C. In some embodiments, the cavity 382 can be filled once the wound roll 320 is positioned over the nonadhesive PCM applicator 380.

Figure 3D:
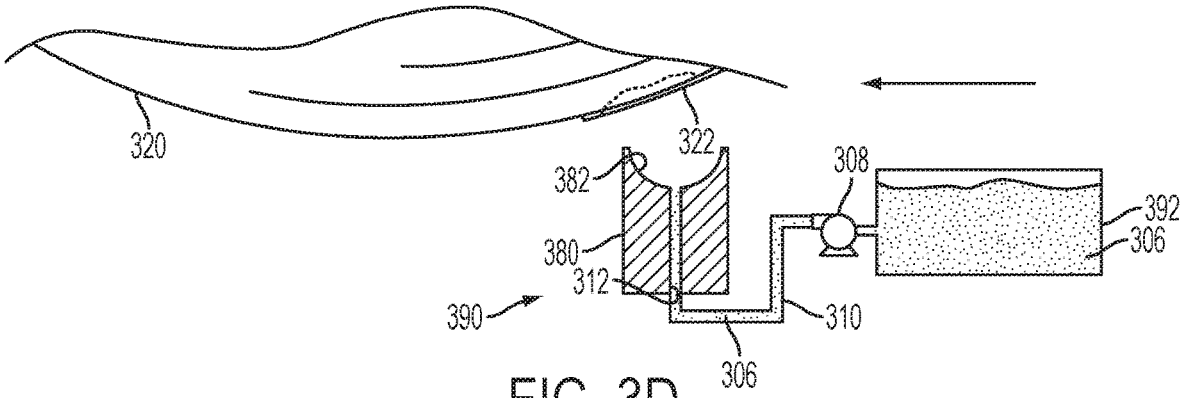

Before being rolled across the nonadhesive PCM applicator 380, the location of the tail 322 can be determined (e.g., using a tail detector). The wound roll 320 can then be indexed to a particular orientation such that a desired portion of the tail 322 (or the wound roll 320) contacts the nonadhesive PCM applicator 380. As the wound roll 320 rolls across the nonadhesive PCM applicator 380, the nonadhesive PCM 306 contained within the cavity 382 can be transferred to the application site. While not schematically depicted in FIG. 3C, in some embodiments, a portion of the wound roll 320 is pushed into the cavity 382 to aid in the transfer of the PCM 306 to the wound roll 320 as the wound roll 320 rolls past the nonadhesive PCM applicator 380. The wound roll 320 can continue to roll in the machine direction past the nonadhesive PCM applicator 308. As shown in FIG. 3D, the cavity 382 may be substantially empty once the wound roll 320 passes the nonadhesive PCM applicator 380. The cavity 382 can then be refilled with nonadhesive PCM 306, as shown in FIG. 3B, in preparation to tail seal the next wound roll.

Figure 4A:
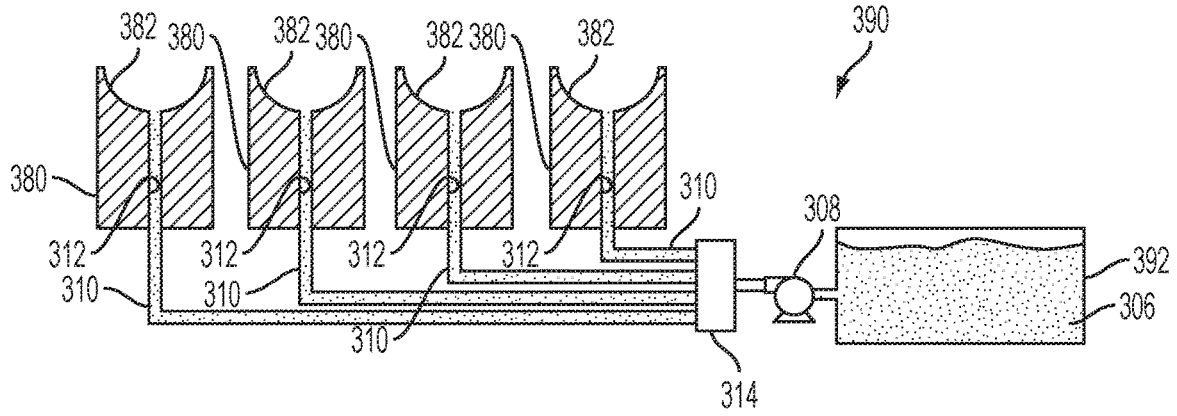
FIGS. 4A-4C schematically depict a progression of an example nonadhesive PCM application system that includes a plurality of stationary nonadhesive applicators disposed in the cross direction.
Figure 4B:
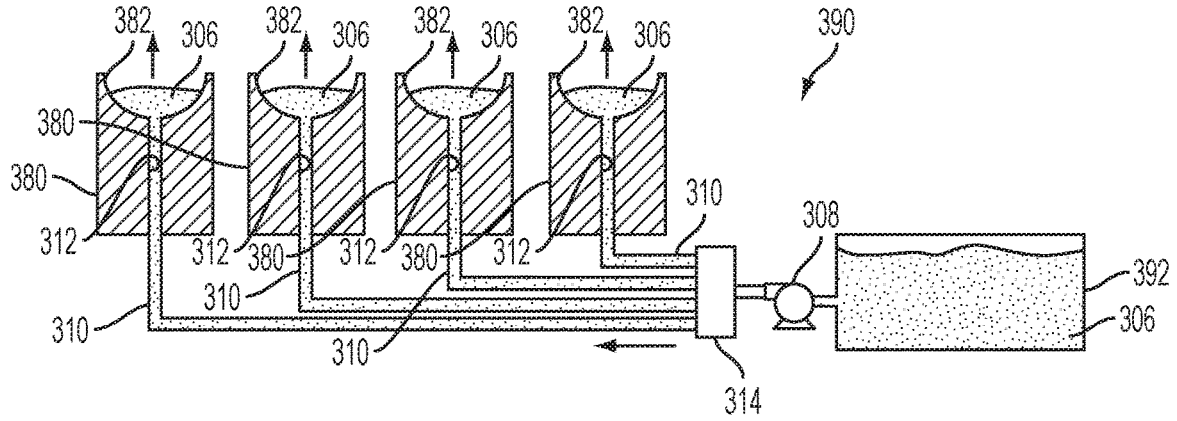
Figure 4C:
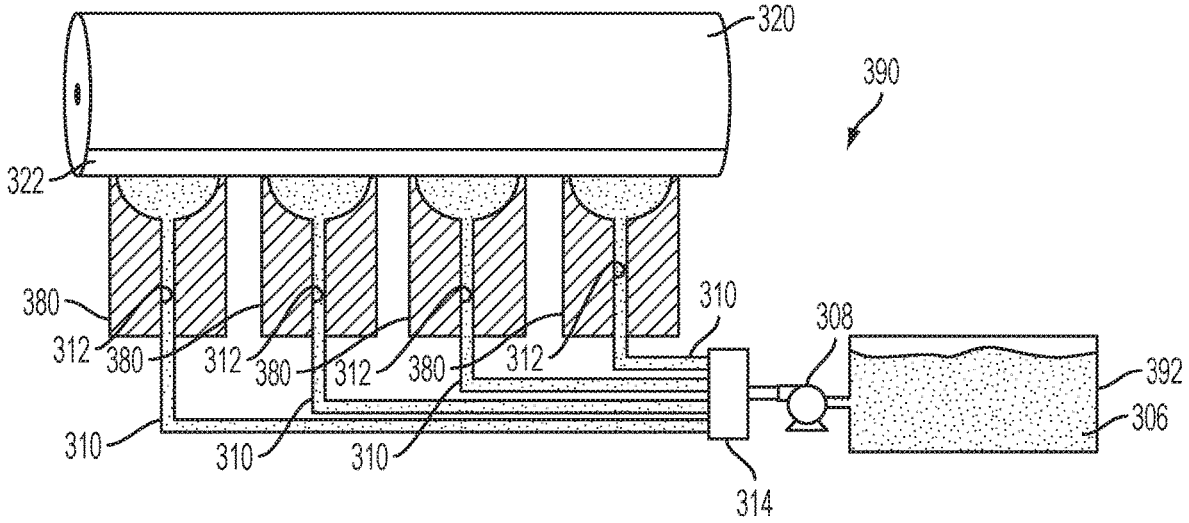

In some embodiments, two or more stationary nonadhesive PCM applicators 380 can be utilized. FIGS. 4A-4C schematically depict a progression of an example nonadhesive PCM application system 390 that includes a plurality of stationary nonadhesive PCM applicators 380 extending in the cross direction. Similar to FIGS. 3A-3D, each nonadhesive PCM applicator 380 has a filling port 312 in fluid communication with a supply line 310. In this embodiment, each supply 310 is fluidly coupled to a manifold 314 and the manifold 314 is fluidly coupled to the pump 308. While a pump and manifold arrangement is depicted in FIGS. 4A-4D, in other embodiments other pumping arrangements can be used. For example, each nonadhesive PCM applicator 380 can have its own dedicated pump 308. Referring now to FIG. 4A, the cavities 382 are shown to be empty. Similar to FIG. 3C described above, the cavities 382 can be selectively filled with a volume of PCM 306, as shown in FIG. 4B. FIG. 4C depicts a wound roll 320 being rolled across the top of the nonadhesive PCM applicators 380. Once the would roll 320 passes by the nonadhesive PCM applicators 380, the cavities 382 can again be refilled with nonadhesive PCM 306 to prepare to tail seal the next wound roll.

Figure 7:
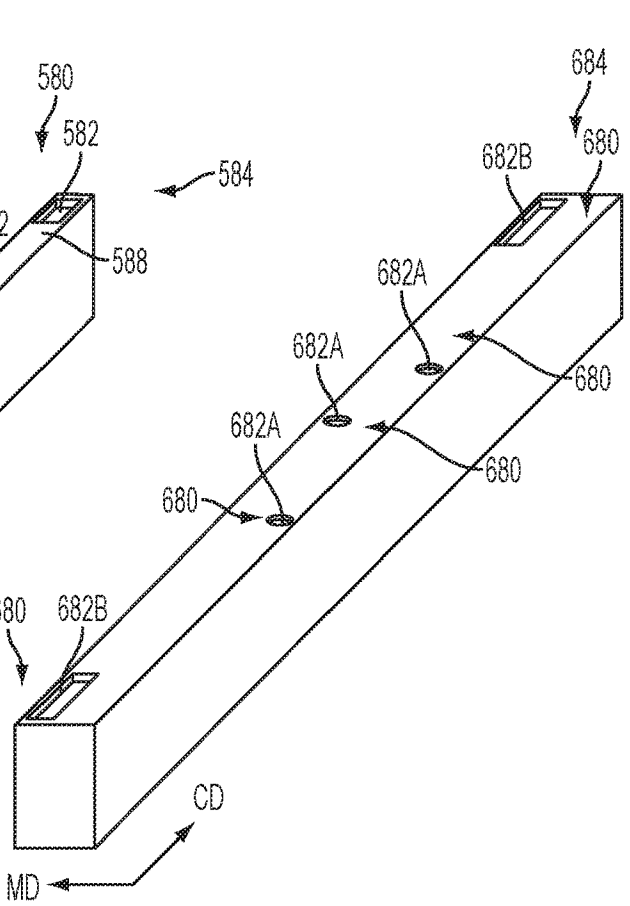
FIGS. 5-7 depict example reciprocating members of nonadhesive PCM application apparatuses.
Figure 6:
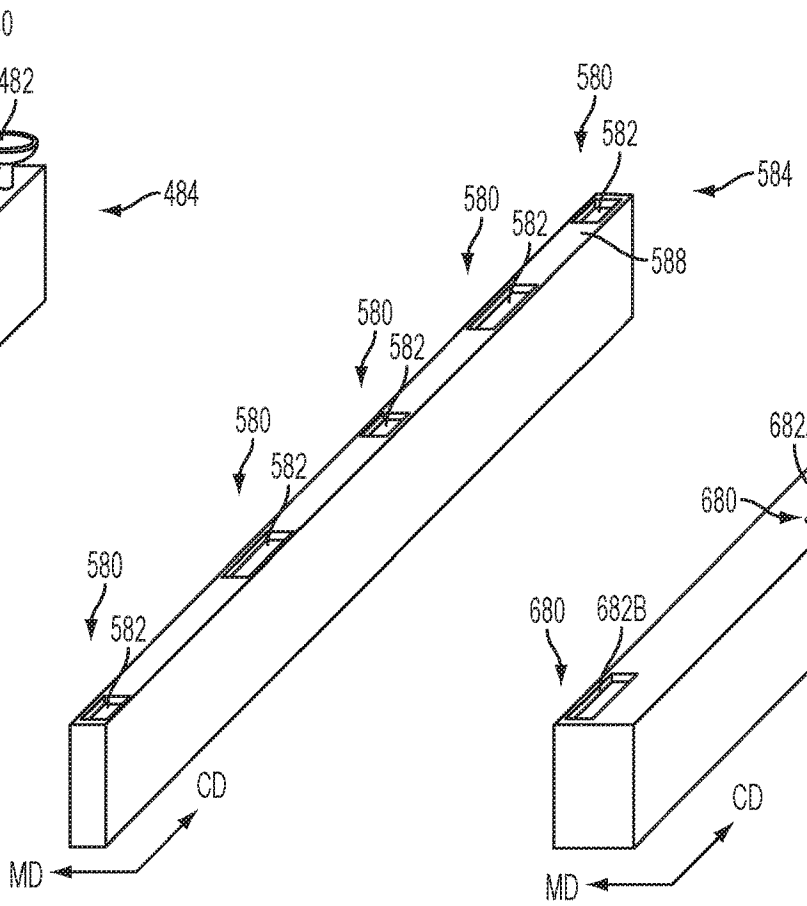
Figure 5:
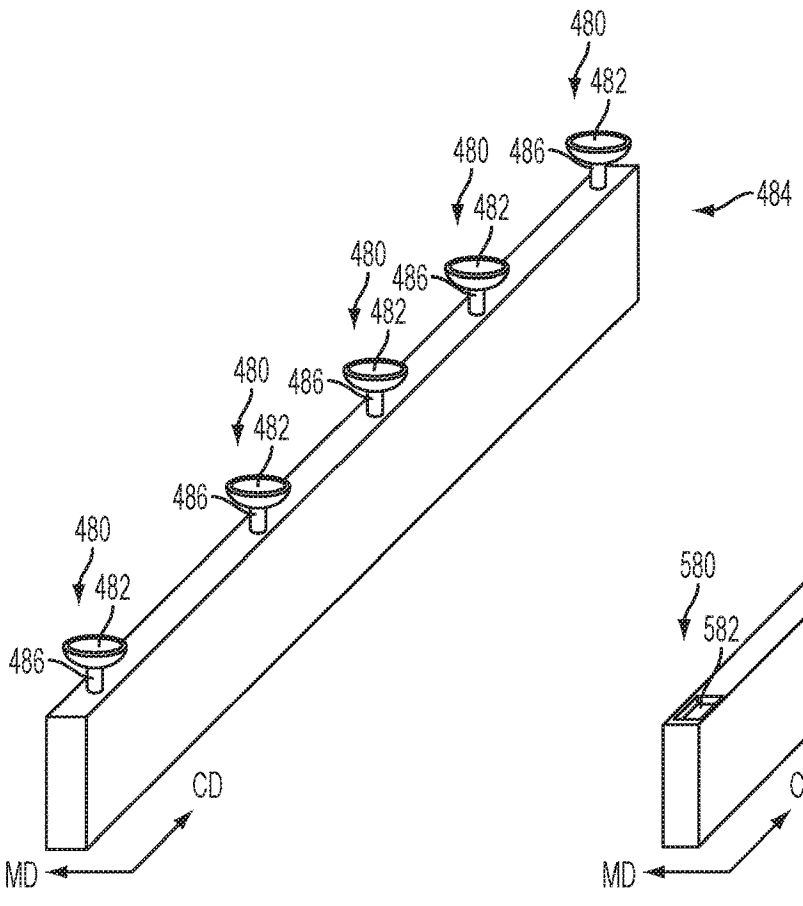

FIGS. 5-7 depict example reciprocating members of nonadhesive PCM application systems. Nonadhesive PCM applicators in accordance with the present disclosure can be coupled to (either permanently or selectively) or otherwise formed by the reciprocating members. Each reciprocating member 484, 584, 684 can reciprocate to submerge the nonadhesive PCM applicators (480, 580, 680) into nonadhesive PCM in an amorphous state (not shown). Referring first to the reciprocating member 484 of FIG. 5, a plurality of nonadhesive PCM applicators 480 are disposed along the reciprocating member 484 in the CD. Each nonadhesive PCM applicator 480 defines a cavity 482 that is sized to hold a volume of nonadhesive PCM. In this embodiment, the cavities 482 are shown as cups that are coupled to or formed with pegs 486. The pegs 486 can be coupled to the reciprocating member 484 using any suitable coupling, such as a threaded connection, a friction fit connection, or a weld connection, for example. Referring now to reciprocating member 584 depicted in FIG. 6, the cavities 582 of nonadhesive PCM applicators 580 are formed by a top surface 588 of the reciprocating member 584. As depicted, each cavity 582 can be sized to similarly or differently from other cavities 582 of the nonadhesive PCM applicators 580. Referring now to FIG. 7, a reciprocating member 684 is depicted having a plurality of nonadhesive PCM applicators 680 that are staggered such that they are not linearly aligned in the CD. Furthermore, the nonadhesive PCM applicators 680 define cavities having a variety of different shapes, including circular cavities 682A and rectangular cavities 682B.

Figure 8:
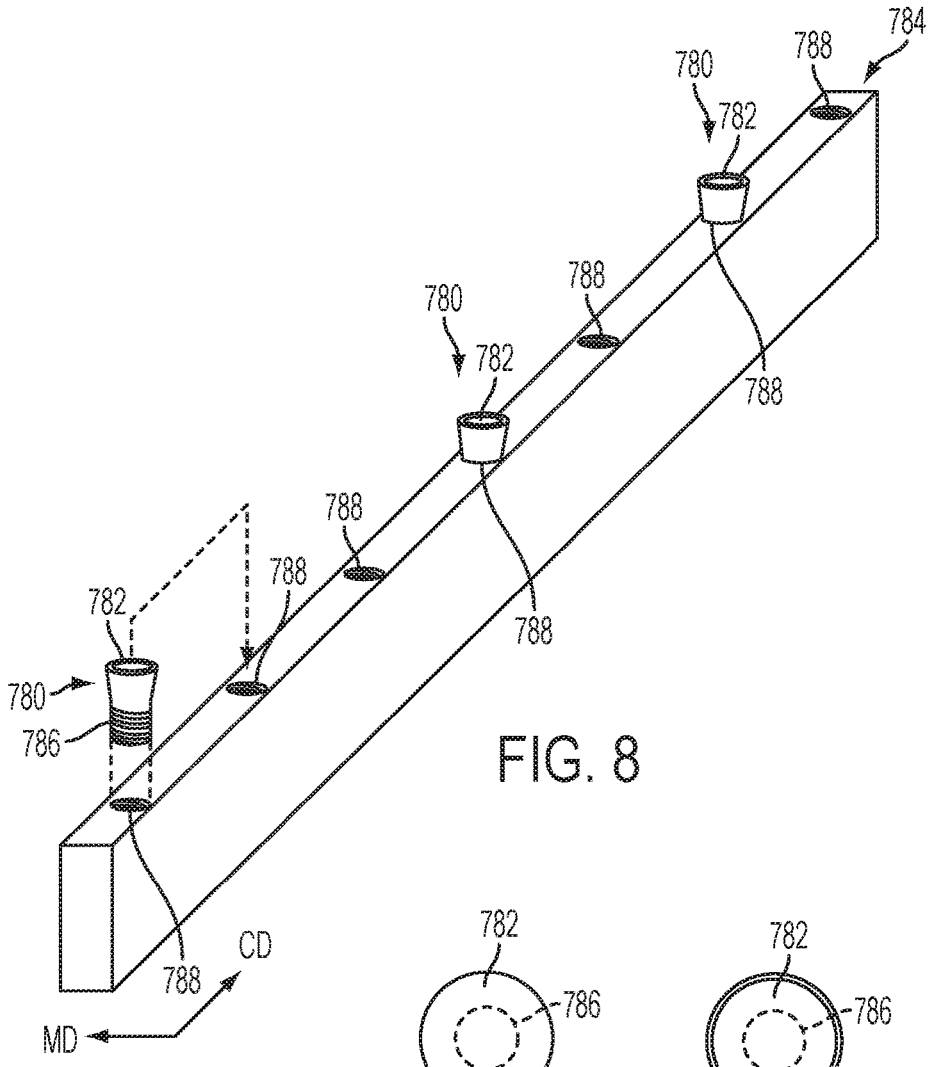
FIG. 8 depicts a reciprocating member of a nonadhesive PCM application apparatus in accordance with one nonlimiting embodiment.

FIG. 8 depicts a reciprocating member 784 of a nonadhesive PCM application system in accordance with one non-limiting embodiment. A plurality of peg-like nonadhesive PCM applicators 780 are shown that each define a cavity 782 and also comprise a threaded portion 786. The reciprocating member 784 defines a plurality of threaded positions 788. While seven threaded positions 788 are depicted in FIG. 8, any suitable number of threaded positions 788 can be used. Furthermore, while the threaded positions 788 are linear in the CD, some embodiments can utilize threaded positions 788 that are in a grid, staggered, or otherwise arranged to provide desired placement locations. The nonadhesive PCM applicators 780 can be selectively coupled to the threaded positions 788 of the reciprocating member 784 to achieve a desired arrangement of nonadhesive PCM applicators 780. Accordingly, the particular arrangement of nonadhesive PCM applicators 780, and even the style of nonadhesive PCM applicator itself, can be changed to suit various manufacturing needs. While threaded connectors are depicted in FIG. 8 it is so be appreciated that any suitable connection technique can be utilized, such as friction-fit connectors, magnetic connectors, snap-fit connectors, and so forth.

Figure 9A:
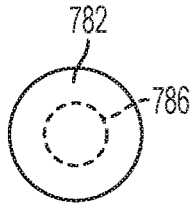
FIG. 9A depicts a top view of an example nonadhesive PCM applicator.
Figure 10A:
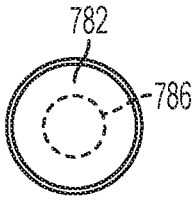
FIG. 10A depicts a top view of an example nonadhesive PCM applicator.
Figure 11A:
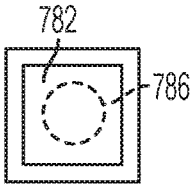
FIG. 11A depicts a top view of an example nonadhesive PCM applicator.
Figure 9B:
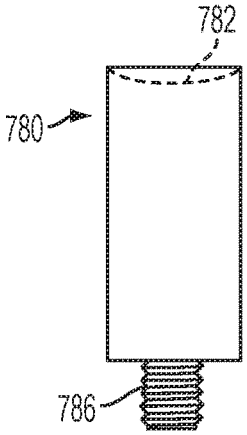
FIG. 9B depicts a side view of the nonadhesive PCM applicator shown in FIG. 9A.
Figure 10B:
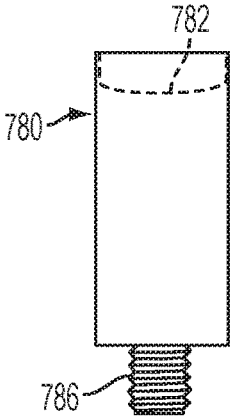
FIG. 10B depicts a side view of the nonadhesive PCM applicator shown in FIG. 10A.
Figure 11B:
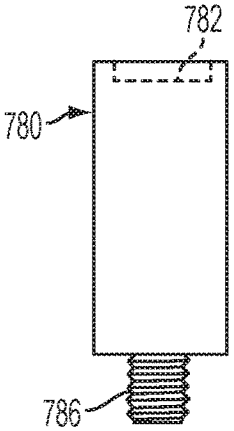
FIG. 11B depicts a side view of the nonadhesive PCM applicator shown in FIG. 11A.
Figure 12:
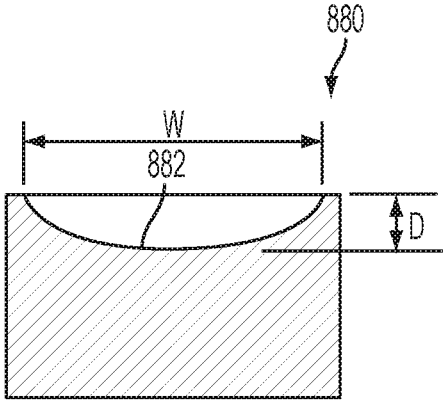
FIGS. 12-17 depict cross-sectional views of example nonadhesive PCM applicators.
Figure 13:
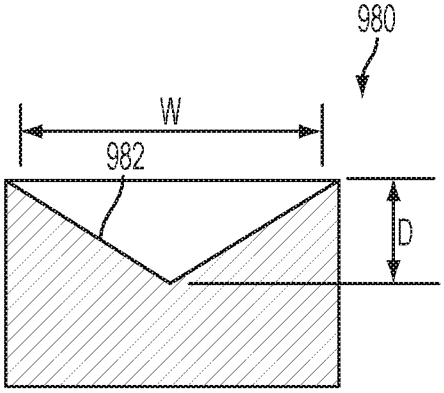
Figure 14:
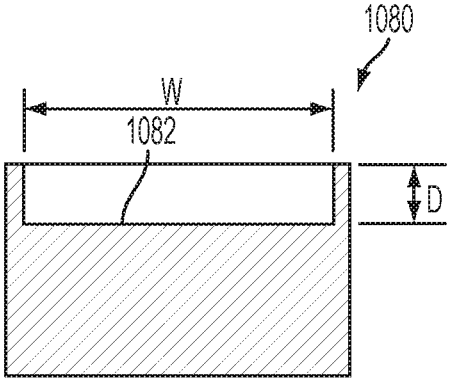
Figure 15:
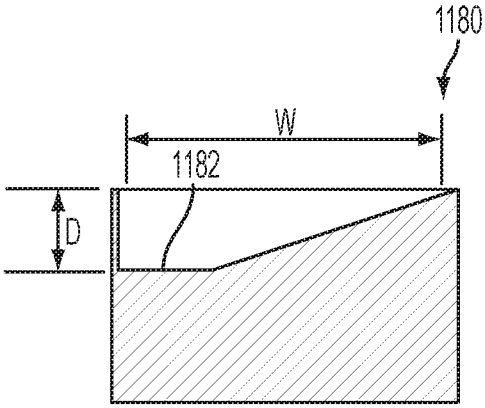
Figure 16:
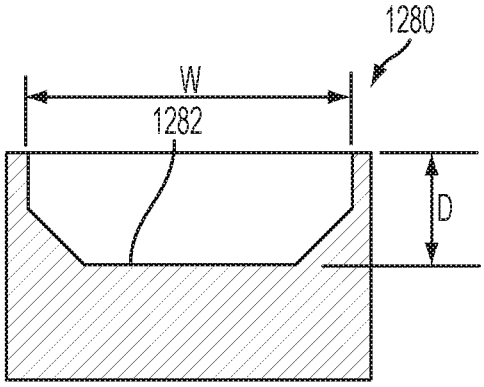
Figure 17:
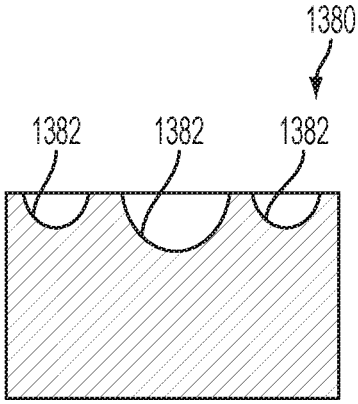

FIGS. 9A-9B, 10A-10B, and 11A-11B depict example alternate arrangements for the peg-like nonadhesive PCM applicator 780 of FIG. 8. FIGS. 9A, 10A, and 11A depict top views and FIGS. 9B, 10B, and 11B depict side views of example configurations for the nonadhesive PCM applicator 780. Referring first to FIGS. 9A-9B, the cavity 782 is hemispherical and extends substantially to the outside edge of the nonadhesive PCM applicator 780. The cavity 782 can be formed through any suitable technique such as milling, for example. Referring next to FIGS. 10A-10B, the cavity 782 is has substantially vertical walls that extend downward toward a hemispherical bottom surface. Referring next to FIGS. 11A-11B, the cavity 782 has substantially vertical walls that extend downward toward a flat bottom surface. As is to be appreciated, a variety of suitable cavity arrangements can be utilized without departing from the scope of the present disclosure.

FIGS. 12-17 depict cross-sectional views of example nonadhesive PCM applicators 880, 980, 1080, 1180, 1280, 1380 in accordance with various non-limiting embodiments. Each nonadhesive PCM applicator 880, 980, 1080, 1180, 1280, 1380 defines a respective cavity 882, 982, 1082, 1182, 1282, 1382. As illustrated, the particular cavity profile can vary. In some embodiments, the cavity can be generally symmetrical (see FIG. 12) while in other embodiments the cavity can be asymmetrical (see FIG. 15). Each cavity can have a width (shown as W, as measured at the widest part of the cavity) and a depth (shown as D, as measured at the deepest part of the cavity). In some embodiments, the width is greater than the depth. In some embodiments, the depth is greater than the width. In some embodiments, the depth is substantially equal to the width. In some embodiments, the ratio of the width to the depth is in the range of about 2:1 to about 10:1. The volume defined by the cavity can be, for example, between about 0.025 mL and 0.1 mL. In one embodiment, the volume defined by the cavity is between about 0.050 mL and 0.075 mL.

Figure 18:
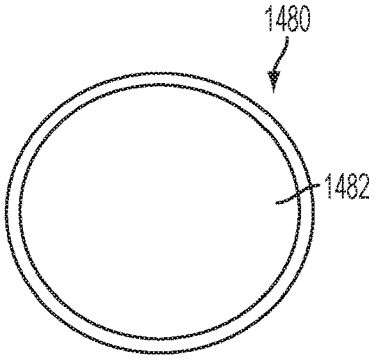
FIGS. 18-25 depict top views of example nonadhesive PCM applicators.
Figure 19:
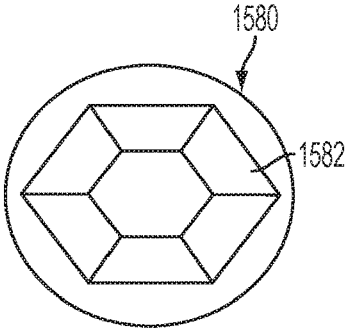
Figure 20:
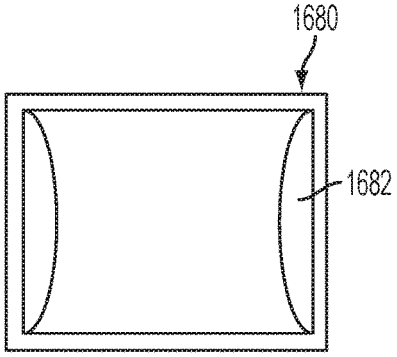
Figure 21:
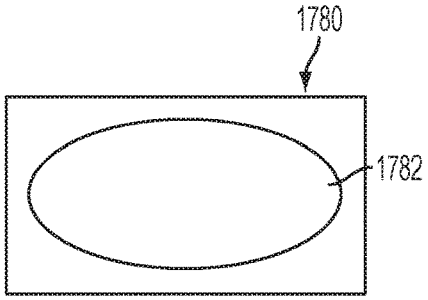
Figure 22:
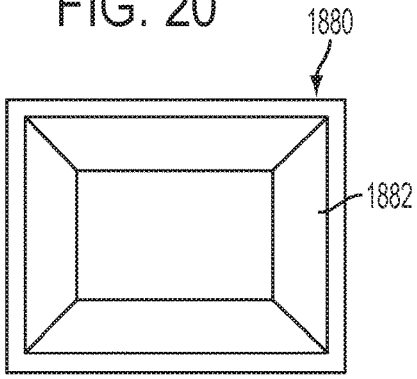
Figure 23:
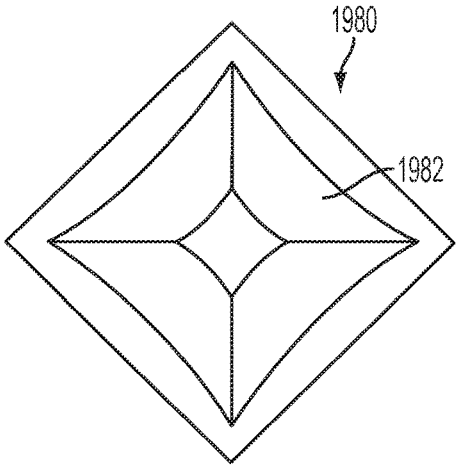
Figure 24:
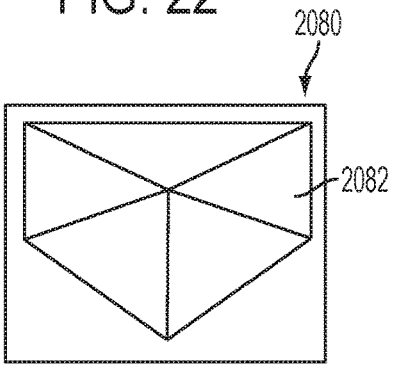
Figure 25:
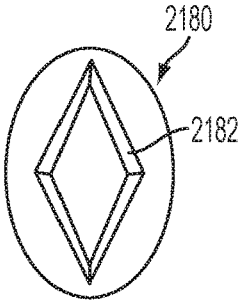

FIGS. 18-25 depict top views of example nonadhesive PCM applicators 1480, 1580, 1680, 1780, 1880, 1980, 2080, 2180 in accordance with various non-limiting embodiments. FIGS. 18-25 illustrate that cavities 1482, 1582, 1682, 1782, 1882, 1982, 2082, 2182 can be defined by a variety of different shapes and arrangements. As is to be appreciated, the particular shape or arrangement of the cavity can determine how the nonadhesive PCM visually appears to a consumer once the nonadhesive PCM is in the tail sealing process. Accordingly, the nonadhesive PCM applied to an application site by nonadhesive PCM applicator 2182 (FIG. 25) has a different shape than nonadhesive PCM applied to an application site by nonadhesive PCM applicators 1480 (FIG. 18). The particular shape or arrangement of the cavity can also affect how efficiently the nonadhesive PCM can be transferred from the cavity to a wound roll. In this regard, the material properties of a first product may be more suited for a first cavity arrangement while the material properties of a second product may be more suited for a second cavity arrangement.

Figure 26:
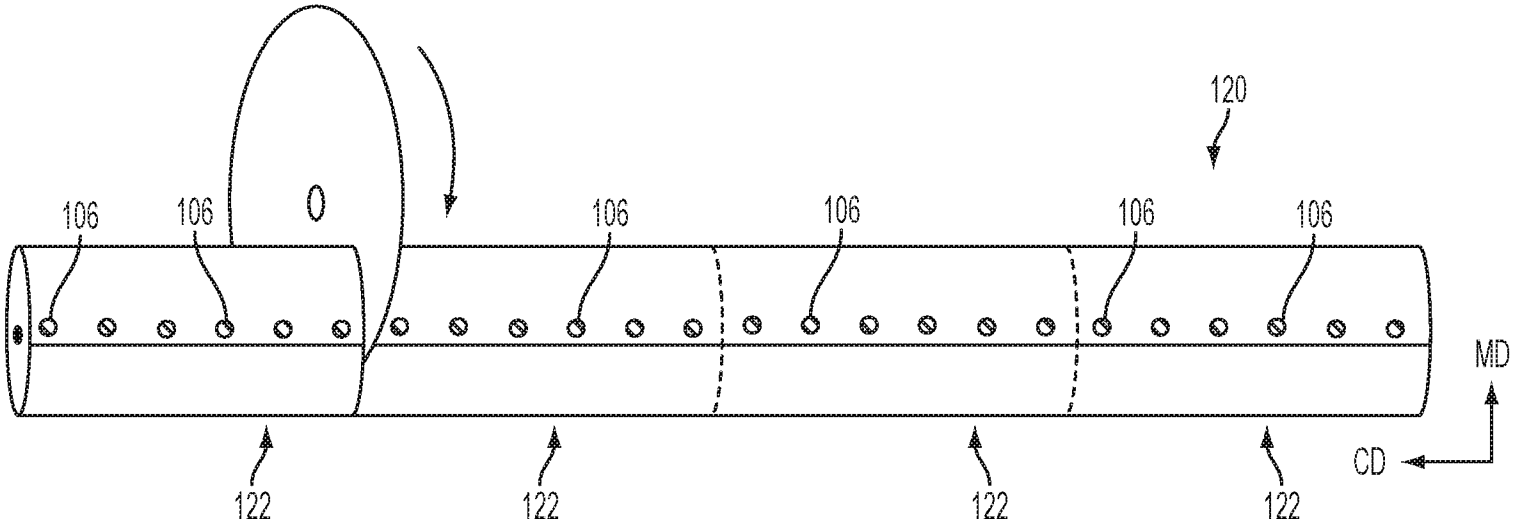
FIGS. 26 and 27 schematically depict a wound log being cut into a plurality of consumer-sized wound rolls.
Figure 27:
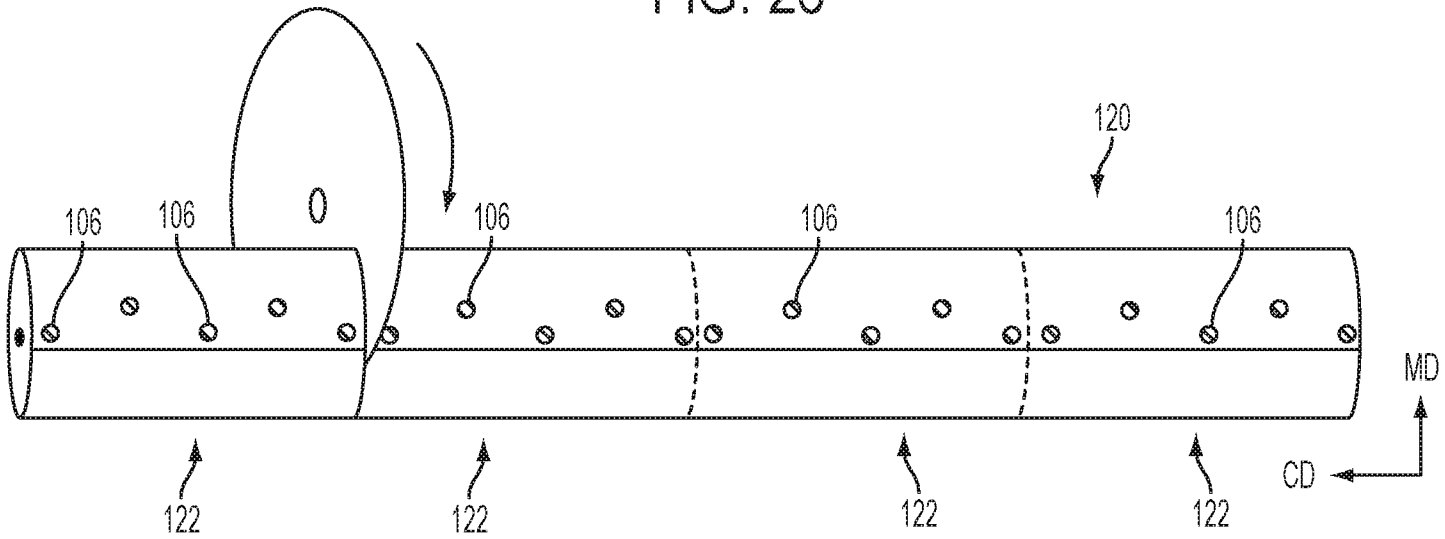

During the manufacturing process, the wound logs (such as wound log 120 depicted in FIG. 1) can be cut into two or more consumer-sized rolls. FIGS. 26 and 27 schematically depict a wound log 120 being cut into a plurality of consumer-sized wound rolls 122. The nonadhesive PCM application system 290 (FIG. 1) has applied the nonadhesive PCM to a plurality of application sites 106 to affix the tail to the body. The application sites 106 of FIG. 26 are substantially linear and evenly spaced in the CD. By comparison, the application sites of FIG. 27 are staggered and non-evenly spaced in the CD. It is noted that the relative size, shape and position of the application sites 106 of FIGS. 26-27 are merely for the purposes of illustration and not intending to be limiting. Further, the nonadhesive PCM can be generally clear or transparent, or can be opaque or comprise a color or tint. It may be desirable, for example, to apply a tinted or colored nonadhesive PCM at certain application sites 106 and apply clear or transparent nonadhesive PCM at other application sites 106. The tinted or colored nonadhesive PCM may aid in instructing the consumer how to efficiently separate the tail from the body. For example, the tinted or colored nonadhesive PCM may be applied such that it highlights or directs a consumer to a grasping portion of the tail. A grasping portion of the tail may be a portion of the tail that is devoid of nonadhesive PCM, or otherwise includes a relatively lesser amount of nonadhesive PCM or bond strength to facilitate ease in separation of the tail from the body by a consumer. In some embodiments utilizing a nonadhesive PCM, the bonding material may be a first color when in an amorphous phase and a second color when in a non-amorphous phase. In some embodiments, the nonadhesive nonadhesive PCM is a wax, such as a petroleum wax or a synthetic wax, for example. In some embodiments, a graphic, embossing, or other indicator, can be applied or located proximate to a particular portion of the tail and/or the body to visually provide guidance to a consumer. For example, the indicator can be position proximate to a grasping portion of the tail.

Figure 28:
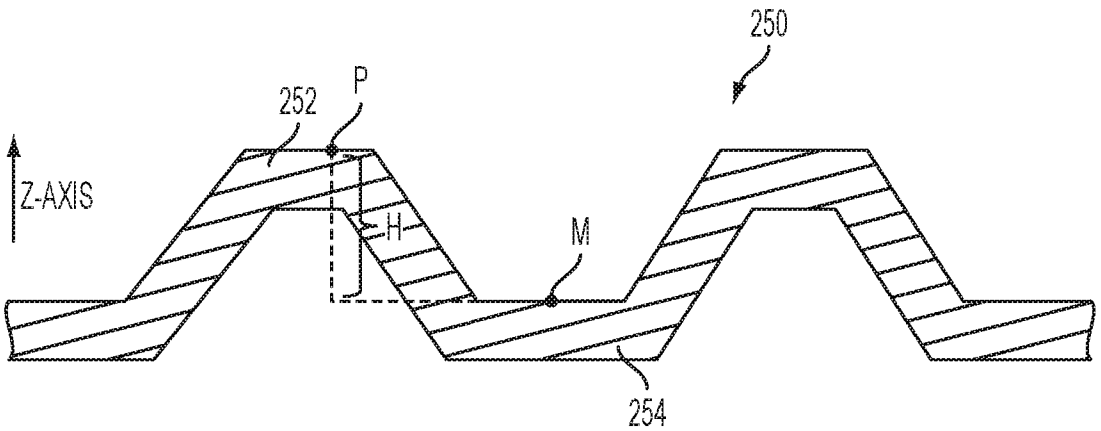
FIG. 28 is a cross-sectional view of an example web material shown in FIG. 26.

The wound roll 122 may comprise a web material 250 that is a fibrous structure. The web material 250 may be provided as a single-ply or multi-ply sanitary tissue product, such as a paper towel product or a bath tissue product, for example. As shown in FIG. 28, which is a cross-sectional view of an example web material 250 shown in FIG. 26, the web material 250 may have a peak 252 and a valley 254, which can be formed by embossing or textural elements. The peak 252 and/or valley 254 may be formed at various stages during the process of making the web material 250. In one nonlimiting example, creping may cause such peaks 252 and/or valleys 254 in a fibrous structure. Likewise, the peaks 252 and/or valleys 254 may be wet-formed, (occurring while the fibers of a fibrous structure are wet) by, for example, a belt having particular shapes or holes. In another nonlimiting example, the peaks 252 and/or valleys 254 of a fibrous structure may be dry-formed (i.e., formed after the fibrous structure is dry) which typically occurs during converting processes such as embossing. In another nonlimiting example, the peaks 252 are formed as a by-product of the formation of valleys 254 in the web material 250. Similarly, the valleys 254 may be formed as a by-product of the formation of peaks 252 in the web material 250.

Generally, the peaks 252 and valleys 254 extend in opposite directions in Z-direction. In one nonlimiting example, a peak 252 extends upward in the Z-direction. The valley 254 in this case may extend downward in the Z-direction, away from the peak 252. In one embodiment, the peak 252 is located on the tail 220. In another embodiment, the peak 252 is located on the body 130 (i.e., the non-tail portion). Alternatively, the peaks 252 may be found on both the body 130 and the tail 220. Likewise, valleys 254 may be located on the tail 220, the body 130 or both the portions of the web material 250. The peaks 252 and/or valleys 254 may be found on one or multiple sides of the web material 250. Where multiple peaks 252 are found on the web material 250, said peaks 252 may comprise different heights, shapes and/or sizes. Likewise, where multiple valleys 254 are found on a web material 250, the valleys 254 may comprise different heights, shapes and/or sizes.

In one nonlimiting example, a peak 252 and valley 254 are adjacent and have a maximum height distance, H, of about 180 microns to about 1750 microns between them. In another nonlimiting example, the maximum height distance, H, is from about 365 microns to about 780 microns. The height distance is measured by measuring the corresponding features of the embossing roll (i.e., a ridge, tooth, etc.), or other apparatus, used to apply or otherwise produce the peak 252 and the valley 254 in the web material 250.

In one nonlimiting example, as shown in FIG. 28, the peak 252 has a maximum height, P, as measured in the Z-direction when the web material 250 having the peak 252 is laid against a flat surface. In such instance, P is measured from the point furthest away from the flat surface in the Z-direction. An adjacent valley 254 may have a minimum height, M, which may be the furthest point from P in the Z-direction within the valley 254. The maximum height distance, H, would be the distance from P to M, along the Z-axis. In one embodiment, nonadhesive PCM is uniformly distributed, such that a sufficient number of bonding sites exist on the peak 252 to ensure maximum bonding of the tail 220 to the body 130 within about 1 minute to about 10 minutes, or within about 1 minute to about 5 minutes, or within about 1 minute to about 2 minutes after application.

The dimensions and/or values disclosed herein are not to be understood as being strictly limited to the exact numerical dimension and/or values recited. Instead, unless otherwise specified, each such dimension and/or value is intended to mean both the recited dimension and/or value and a functionally equivalent range surrounding that dimension and/or value. For example, a dimension disclosed as "40 mm" is intended to mean "about 40 mm".

Every document cited herein, including any cross referenced or related patent or application is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A system for adhesively bonding a tail of a convolutely wound log of web material to a body of the convolutely wound log of web material, the system comprising:

a tail identifying system for identifying the presence and position of the tail of the web material, wherein the web material comprises peaks and valleys; and a nonadhesive phase-change material application apparatus positioned downstream from the tail identifying system to receive the log from the tail identifying system, the nonadhesive phase-change material application apparatus comprising:

at least one nonadhesive phase-change material reservoir for storing nonadhesive phase-change material in an amorphous phase, wherein the at least one nonadhesive phase-change material reservoir is heated; and a plurality of nonadhesive phase-change material applicators that are heated, each of the plurality of nonadhesive phase-change material applicators being translatable between a first position and a second position, wherein each of the plurality of nonadhesive phase-change material applicators are submergible into the nonadhesive phase-change material in the first position, wherein each of the plurality of nonadhesive phase-change material applicators are configured to contact an exterior portion of the tail of the web material in the second position such that a sufficient number of bonding sites exist on the peaks of the web material to bond the tail to the body of the convolutely wound log of web material, and wherein each of the plurality of nonadhesive phase-change material applicators defines a cavity for carrying nonadhesive phase-change material during translation from the first position to the second position.

2. The system of claim 1, wherein each of the plurality of nonadhesive phase-change material applicators comprises a conductive material.

3. The system of claim 1, wherein the cavity of at least one of the plurality of nonadhesive phase-change material applicators is generally hemispherically shaped.

4. The system of claim 3, wherein the cavity of each of the plurality of nonadhesive phase-change material applicators is hemispherically shaped.

5. The system of claim 1, wherein the cavity of at least one of the plurality of nonadhesive phase-change material applicators is generally cylindrically shaped.

6. The system of claim 1, wherein the cavity of at least one of the plurality of nonadhesive phase-change material applicators is multi-faceted.

7. The system of claim 1, wherein the cavity of at least one of the plurality of nonadhesive phase-change material applicators has a width and a depth, wherein:

the width is greater than the depth;

the depth is greater than the width; or the depth is substantially equal to the width.

8. The system of claim 1, wherein each of the plurality of nonadhesive phase-change material applicators are generally cylindrically shaped, and wherein the cavity of each of the plurality of nonadhesive phase-change material applicators is generally hemispherically shaped.

9. The system of claim 1, wherein each of the plurality of nonadhesive phase-change material applicators translates between the first position and the second position along a translation axis.

10. The system of claim 9, wherein the cavity of each of the plurality of nonadhesive phase-change material applicators has a circular cross-sectional shape taken orthogonal to the translation axis.

11. The system of claim 9, wherein the cavity of each of the plurality of nonadhesive phase-change material applicators has a polygonal cross-sectional shape taken orthogonal to the translation axis.

12. The system of claim 9, wherein the cavity of each of the plurality of nonadhesive phase-change material applicators has a width of about 0.25 inches or less.

13. The system of claim 11, wherein the polygonal cross-sectional shape is a square.

14. The system of claim 9, wherein the cavity of each of the plurality of nonadhesive phase-change material applicators has a semi-circular cross-sectional shape taken parallel to the translation axis.

15. The system of claim 1, wherein the cavity of each of the plurality of nonadhesive phase-change material applicators is defined by inwardly converging sidewalls.

16. The system of claim 1, wherein the cavity of at least one of the plurality of nonadhesive phase-change material applicators is sized to hold a volume of nonadhesive phase-change material, and wherein the volume is in the range of about 0.05 mL to about 0.075 mL.

17. The system of claim 1, wherein the plurality of nonadhesive phase-change material applicators comprises a first nonadhesive phase-change material applicator and a second nonadhesive phase-change material applicator, wherein the first nonadhesive phase-change material applicator is sized to hold a first volume of nonadhesive phase-change material and the second nonadhesive phase-change material applicator is sized to hold a second volume of nonadhesive phase-change material, and wherein the first volume is different than the second volume.

18. The system of claim 1, wherein the plurality of nonadhesive phase-change material applicators are linearly aligned in a cross-direction.

19. The system of claim 1, wherein the plurality of nonadhesive phase-change material applicators are staggered in a cross-direction.

20. The system of claim 1, wherein the plurality of nonadhesive phase-change material applicators comprises three to five nonadhesive phase-change material applicators.

* * * * *